US010202829B2

(12) United States Patent
McGeoch

(10) Patent No.: US 10,202,829 B2
(45) Date of Patent: Feb. 12, 2019

(54) INFLOW CONTROL DEVICE HAVING ELONGATED SLOTS FOR BRIDGING OFF DURING FLUID LOSS CONTROL

(71) Applicant: Weatherford/Lamb, Inc., Houston, TX (US)

(72) Inventor: Andrew McGeoch, Aberdeen (GB)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 149 days.

(21) Appl. No.: 14/550,000

(22) Filed: Nov. 21, 2014

(65) Prior Publication Data

US 2015/0176373 A1 Jun. 25, 2015

Related U.S. Application Data

(60) Provisional application No. 61/909,691, filed on Nov. 27, 2013.

(51) Int. Cl.
*E21B 43/08* (2006.01)
*E21B 43/12* (2006.01)
*E21B 21/00* (2006.01)

(52) U.S. Cl.
CPC ..... *E21B 43/08* (2013.01); *E21B 21/003* (2013.01); *E21B 43/12* (2013.01)

(58) Field of Classification Search
CPC ..... E21B 21/003; E21B 43/08; E21B 43/12
USPC ..... 166/244.1, 276, 227
See application file for complete search history.

(56) References Cited

U.S. PATENT DOCUMENTS

| | | | | |
|---|---|---|---|---|
| 7,093,653 | B2 | 8/2006 | Metcalfe et al. | |
| 7,419,002 | B2 | 9/2008 | Dybevik et al. | |
| 7,559,375 | B2 | 7/2009 | Dybevik et al. | |
| 7,644,758 | B2 | 1/2010 | Coronado et al. | |
| 8,096,351 | B2 | 1/2012 | Peterson et al. | |
| 8,291,972 | B2 | 10/2012 | Dusterhoft et al. | |
| 2002/0157837 | A1 | 10/2002 | Bode et al. | |
| 2004/0131812 | A1* | 7/2004 | Metcalfe | E21B 43/086 428/36.9 |
| 2006/0118296 | A1 | 6/2006 | Dybevik et al. | |
| 2006/0231260 | A1 | 10/2006 | Freyer | |
| 2007/0246210 | A1 | 10/2007 | Richards | |

(Continued)

OTHER PUBLICATIONS

Extended European Search Report in counterpart EP Appl. EP 14194766.3, dated Oct. 30, 2015.

(Continued)

*Primary Examiner* — Taras P Bemko
(74) *Attorney, Agent, or Firm* — Blank Rome, LLP

(57) ABSTRACT

A sand screen joint screens borehole fluid during production and bridges off loss control fluid during loss control. The joint has a basepipe having a bore and defining at least one elongated slot therein. Filter media is disposed on the basepipe and screens the borehole fluid. At least one flow device is disposed on the basepipe and restricts communication of the borehole fluid from the filter media to the at least one elongated slot. During the production, the at least one elongated slot communicates the borehole fluid from the at least one flow device to the bore. During the loss control, the at least one elongated slot bridges off with particulate from the loss control fluid communicated from the bore to the at least one flow device.

21 Claims, 4 Drawing Sheets

(56) References Cited

U.S. PATENT DOCUMENTS

| | | | | |
|---|---|---|---|---|
| 2008/0217001 | A1* | 9/2008 | Dybevik | E21B 43/12<br>166/142 |
| 2008/0264628 | A1 | 10/2008 | Coronado | |
| 2010/0243256 | A1 | 9/2010 | Khomynets | |

OTHER PUBLICATIONS

Patent Examination Report No. 1 in counterpart Australian Appl. 2014268163, dated Aug. 28, 2015.
First Office Action in counterpart Canadian Appl. 2,872,264, dated Feb. 26, 2016.
Weatherford, "Well Screen Technologies: FloReg(TM) Inflow Control Technology," Technical Brochure, copyright 2008.

* cited by examiner

INFLOW CONTROL DEVICE HAVING ELONGATED SLOTS FOR BRIDGING OFF DURING FLUID LOSS CONTROL

CROSS-REFERENCE TO RELATED APPLICATIONS

This application claims the benefit of U.S. Provisional Appl. No. 61/909,691, filed 27 Nov. 2013, which is incorporated herein by reference.

BACKGROUND OF THE DISCLOSURE

Reservoir completion systems installed in production, injection, and storage wells often incorporate sand screens positioned across the reservoir sections to prevent sand and other solids particles over a certain size from entering the reservoir completion. Conventional sand screen joints are typically assembled by wrapping a filter media around a perforated basepipe so fluids entering the sand screen from the wellbore must first pass through the filter media. Solid particles over a certain size will not pass through the filter media and will be prevented from entering the reservoir completion.

For example, a reservoir completion system 10 in FIG. 1 has completion screen joints 50 deployed on a completion string 14 in a borehole 12. Typically, these screen joints 50 are used for vertical, horizontal, or deviated boreholes passing in an unconsolidated formation, and packers 16 or other isolation elements can be used between the various joints 50. During production, fluid produced from the borehole 12 directs through the screen joints 50 and up the completion string 14 to the surface rig 18. The screen joints 50 keep out fines and other particulates in the produced fluid. In this way, the screen joints 50 can prevent the production of reservoir solids and in turn mitigate erosion damage to both well and surface components and can prevent other problems associated with fines and particulate present in the produced fluid.

In long horizontal wellbores, there can be a tendency for fluids to preferentially enter the reservoir completion at specific points along its length either by virtue of the properties of the reservoir rock or through the effects of flowing friction. This effect can be undesirable as it will cause uneven reservoir drainage or injection. In these circumstances, it can be beneficial to incorporate inflow control devices (ICDs) into the reservoir completion. Typically, one inflow control device is attached to each sand screen joint 50.

Sand screen joints 50 incorporating inflow control devices are manufactured so that the filter media is wrapped around a drainage layer or support rods (depending on the filter media type), which are positioned on un-perforated portions of the basepipe. The only perforations in the basepipe are positioned beneath the inflow control device.

During production, reservoir fluids travel through the filter media of the sand screen joint 50 and then along the annular gap between the filter media and the basepipe of the screen. Next, the produced fluid passes through a flow restriction (e.g., a tungsten carbide nozzle) and into a housing of the inflow control device before passing through the perforations in the basepipe and into the reservoir completion.

Examples of inflow control devices are disclosed in U.S. Pat. No. 5,435,393 to Brekke et al.; U.S. Pat. No. 7,419,002 to Dybevik et al.; U.S. Pat. No. 7,559,375 to Dybevik et al.; and U.S. Pat. No. 8,096,351 to Peterson et al. Other examples of inflow control devices are also available, including the FloReg ICD available from Weatherford International, the Equalizer® ICD available from Baker Hughes, ResFlow ICD available from Schlumberger, and the Equi-Flow® ICD available from Halliburton. (EQUALIZER is a registered trademark of Baker Hughes Incorporated, and EQUIFLOW is a registered trademark of Halliburton Energy Services, Inc.)

Turning to FIGS. 2A-2C, a prior art completion screen joint 50 having an inflow control device 70 is shown in a side view, a partial side cross-sectional view, and a detailed view. The screen joint 50 has a basepipe 52 with a sand control jacket 60 and inflow control device 70 disposed thereon. The basepipe 52 defines a through-bore 55 and has a coupling crossover 56 at one end for connecting to another joint or the like. The other end 54 can connect to a crossover (not shown) of another joint on the completion string. Inside the through-bore 55, the basepipe 52 defines pipe ports 58 where the inflow control device 70 is disposed.

The joint 50 is connected to a production string (14: FIG. 1) with the screen 60 typically mounted upstream of the inflow control device 70. Here, the inflow control device 70 is similar to the FloReg Inflow Control Device (ICD) available from Weatherford International. As best shown in FIG. 2C, the device 70 has an outer sleeve 72 disposed about the basepipe 52 at the location of the pipe ports 58. A first end-ring 74 seals to the basepipe 52 with a seal element 75, and a second end-ring 76 attaches to the end of the screen 60. Overall, the sleeve 72 defines an annular space around the basepipe 52 that communicates the pipe ports 58 with the sand control jacket 60. The second end-ring 76 has flow ports 80, which separate the sleeve's inner space 86 from the screen 60.

For its part, the sand control jacket 60 is disposed around the outside of the basepipe 52. As shown, the sand control jacket 60 can be a wire wrapped screen having rods or ribs 64 arranged longitudinally along the basepipe 52 with windings of wire 62 wrapped thereabout to form various slots. Fluid from the surrounding borehole annulus can pass through the annular gaps and travel between the sand control jacket 60 and the basepipe 52.

Internally, the inflow control device 70 has nozzles 82 disposed in flow ports 80. The nozzles 82 restrict the flow of screened fluid from the screen jacket 60 into the device's inner space 86 and produce a pressure drop in the fluid. For example, the inflow control device 70 can have ten nozzles 82. Operators set a number of these nozzles 82 open at the surface to configure the device 70 for use downhole in a given implementation. In this way, the device 70 can produce a configurable pressure drop along the screen jacket 60 depending on the number of open nozzles 82.

To configure the device 70, pins 84 can be selectively placed in the passages of the nozzles 82 to close them off. The pins 84 are typically hammered in place with a tight interference fit and are removed by gripping the pin 84 with a vice grip and then hammering on the vice grip to force the pin 84 out of the nozzle 82. These operations need to be performed off rig beforehand so that valuable rig time is not used up. Thus, operators must predetermine how the inflow control devices 70 are to be preconfigured and deployed downhole before setting up the components for the rig.

As fluid flows through the flow nozzles 82 in each inflow control device 70, a pressure drop is created. By plugging a pre-determined quantity of the nozzles 82 in each inflow control device 70 on each sand screen 60, operators can adjust the pressure drop produced along the length of the completion and can consequently configured the production/injection profile of the completion.

When the joints 50 are used in a horizontal or deviated borehole of a well as shown in FIG. 1, the inflow control devices 70 are configured to produce particular pressure drops to help evenly distribute the flow along the completion string 14 and prevent coning of water in the heel section. Overall, the devices 70 choke production to create an even-flowing pressure-drop profile along the length of the horizontal or deviated section of the borehole 12.

Typically, the reservoir section of a well is under positive pressure that acts to force reservoir fluids into the reservoir completion. During completion, work over, intervention and other operational periods when the well is not being produced, the reservoir pressure must be controlled to prevent reservoir fluids from migrating to surface. This is typically achieved by filling the well with a weighted fluid that will counteract the reservoir pressure.

For example, well kill operations may need to be performed through the completion system 10. In these situations, the weighted fluid transmits pressure to the formation down the reservoir completion. Pressure is transmitted down the tubulars to the basepipe 52, through the perforations 58 in the basepipe 52, and into the inflow control device 70. From here, the pressure then passes through the open flow nozzles 82, along the non-perforated portion of the basepipe 52, and finally out through the screen section 60. FIG. 2C shows the path of such pressure transmission.

A situation can arise where the balance between the fluid weight and the reservoir pressure is lost, and fluid either begins to flow into or out of the reservoir in an uncontrolled manner. In these situations, it is necessary to re-gain control of the fluid balance through a process called "killing the well".

Killing the well is typically achieved by circulating a weighted fluid into the well that places a significantly high enough pressure against the wellbore to overcome the reservoir pressure. It is also necessary to prevent this weighted fluid from continuing to leak into the reservoir section. This is achieved by mixing a Loss Control Material (LCM) in with the weighted fluid. LCM can be made up of solid particles of a specific size that are designed to rest against the area where the fluid is leaking into the reservoir section. The solid particles bridge off at the area to plug off the leak temporarily.

When conventional sand screens without inflow control devices are used in the completion across a reservoir section, the LCM will bridge off against the inside diameter of the filter media of the sand screen. Once the balance between the fluid in the wellbore and the reservoir pressure has been re-established, the fluid from the well can be produced to the surface in a controlled manner that will lift the LCM away from the filter media of the sand screen and re-establish the flow path.

In wells where sand screen joints 50 incorporating inflow control devices 70 are installed across the wellbore, successfully killing the well can prove more difficult. Due to the inflow control devices 70, the LCM does not have a clear path to the inside of the filter media in each sand screen joint 50 during the process of killing the well. Also, it may also be difficult to successfully remove the LCM from the inside diameter of the filter media due to the restricted flow path through the inflow control device 70. This difficulty in removing the LCM can have an impact on the ability to successfully produce or inject from the well after the event.

One technique for addressing this issue involves installing a section of sized filter media on a valve at the inlet to the inflow control device 70. This allows the LCM to bridge off across this filter media and kill the well against the valve. In this scenario, the LCM does not need to flow into the sand screen joint 50 and does not need to bridge against the inside of the filter media. This method is disclosed in U.S. Pat. No. 7,644,758 to Coronado et al.

Although the inflow control devices of the prior art may be effective, it is desirable to be able to configure the pressure drop for a borehole and to kill the well using LCM in more reliable ways.

The subject matter of the present disclosure is, therefore, directed to overcoming, or at least reducing the effects of, one or more of the problems set forth above.

SUMMARY OF THE DISCLOSURE

A sand control apparatus, which can be a joint for a completion string, has a basepipe with a bore for conveying the production fluid to the surface. To prevent sand and other fines from passing through openings in the basepipe to the bore, a screen can be disposed on the basepipe for screening fluid produced from the surrounding borehole, although a screen may not be always used. Disposed on the basepipe, an inflow control device has a housing defining a housing chamber in fluid communication with screened fluid from the screen. During production, fluid passes through the screen, enters the housing chamber, and eventually passes into the basepipe's bore through the pipe's openings.

To control the flow of the fluid and create a desired pressure drop for even-flow along the screen joint, at least one flow device disposed on the joint controls fluid communication from the housing's chamber to the openings in the basepipe. In one implementation, the at least one flow device includes one or more flow ports having nozzles. A number of the flow ports and nozzles may be provided to control fluid communication for a particular implementation, and the nozzles can be configured to allow flow or to prevent flow by use of a pin, for example.

The basepipe's flow openings are elongated slots. During production, the elongated slots communicate the borehole fluid from the at least one flow device to the basepipe's bore. During loss control to kill the well, however, the elongated slots bridge off with particulate from the loss control fluid communicated from the basepipe's bore to the inflow control device. In this way, the particulates in the loss control fluid do not need to enter the flow device and engage inside the filter media to kill the well.

The foregoing summary is not intended to summarize each potential embodiment or every aspect of the present disclosure.

DETAILED DESCRIPTION OF THE DISCLOSURE

Figure 1:
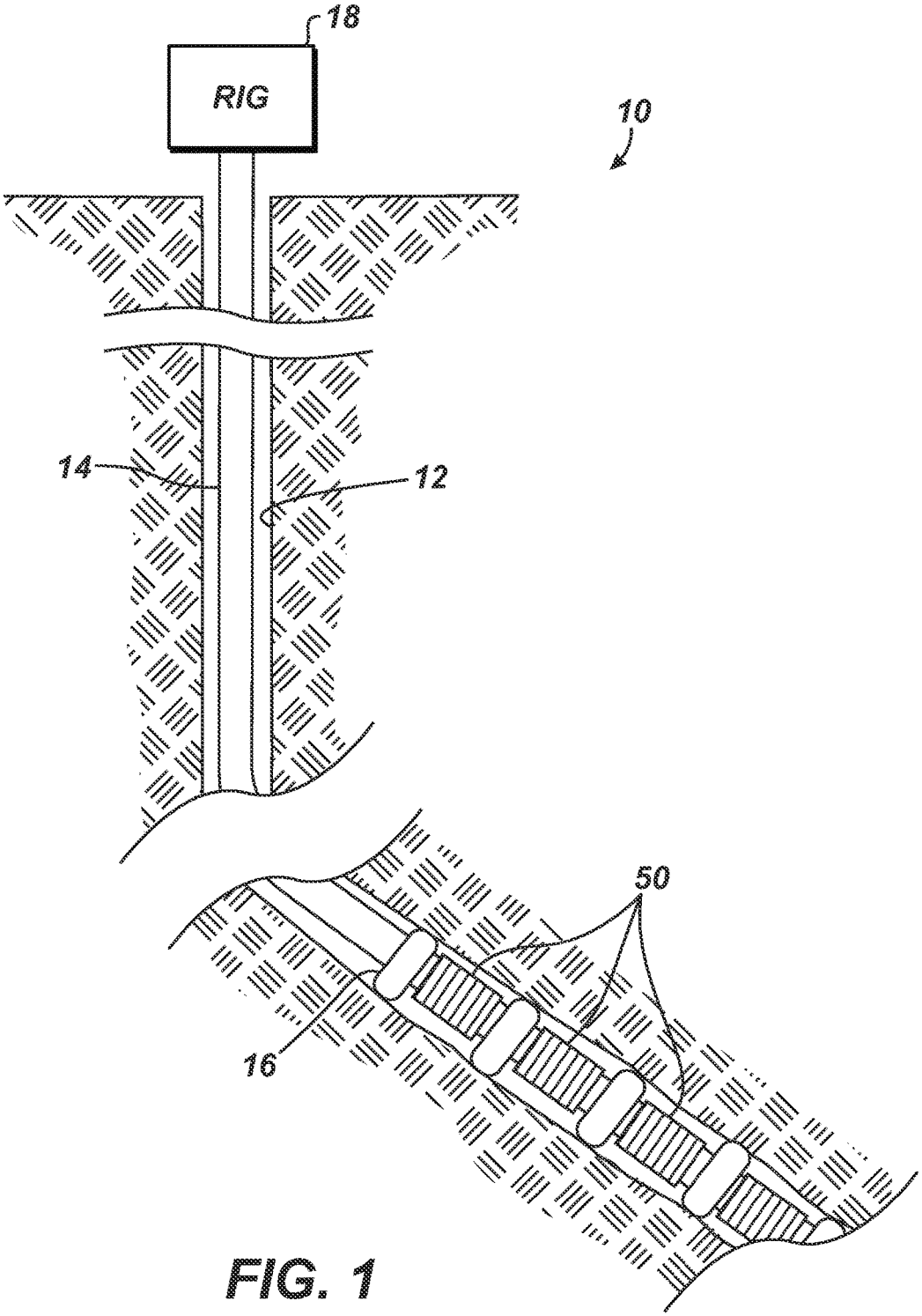
FIG. 1 (Prior Art)
FIG. 1 illustrates a completion system having completion joints deployed in a borehole.
Figure 2A:
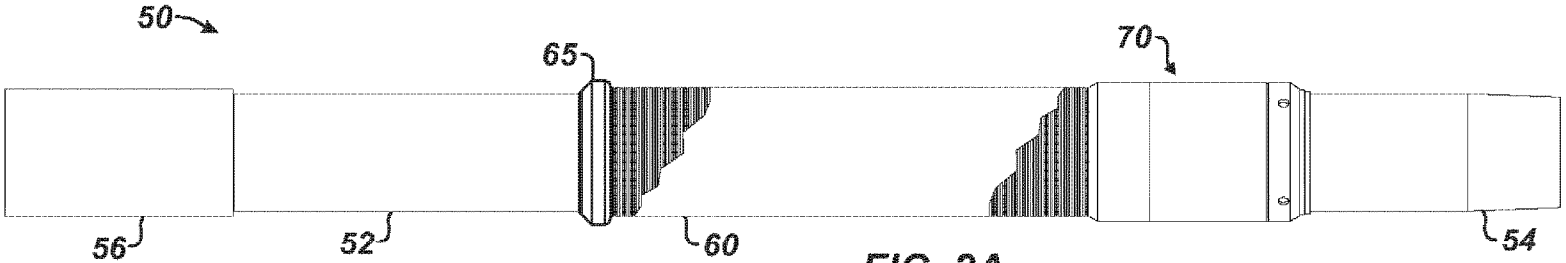
FIG. 2A (Prior Art)
FIG. 2A illustrates a completion screen joint according to the prior art.
Figure 2B:
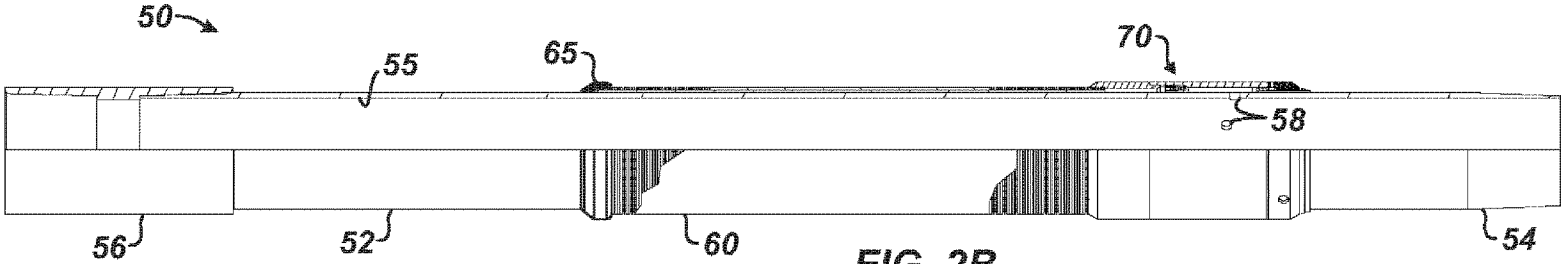
FIG. 2B (Prior Art)
FIG. 2B illustrates the prior art screen joint in partial cross-section.
Figure 2C:
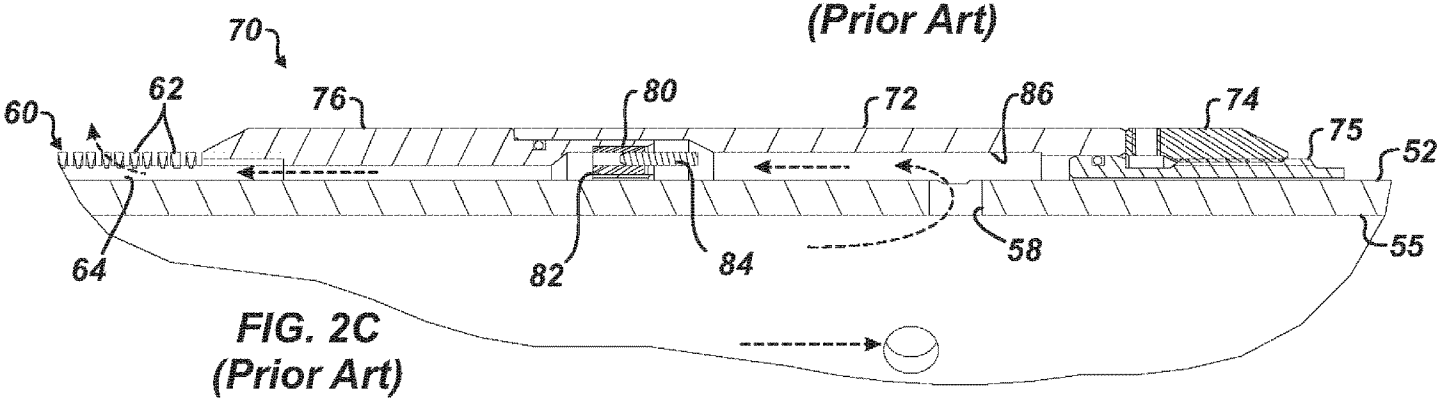
FIG. 2C (Prior Art)
FIG. 2C illustrates a detail of the prior art screen joint.
Figure 3A:
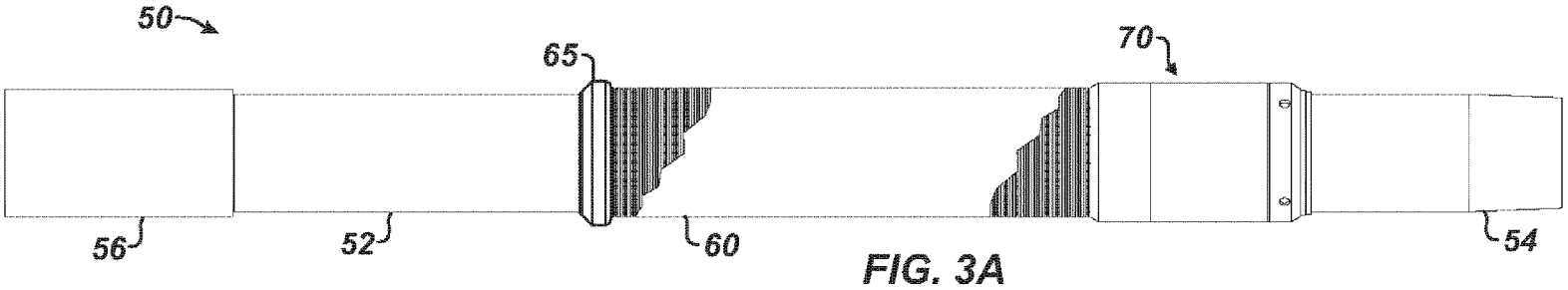
FIG. 3A illustrates a completion screen joint having an inflow control device according to the present disclosure.
Figure 3B:
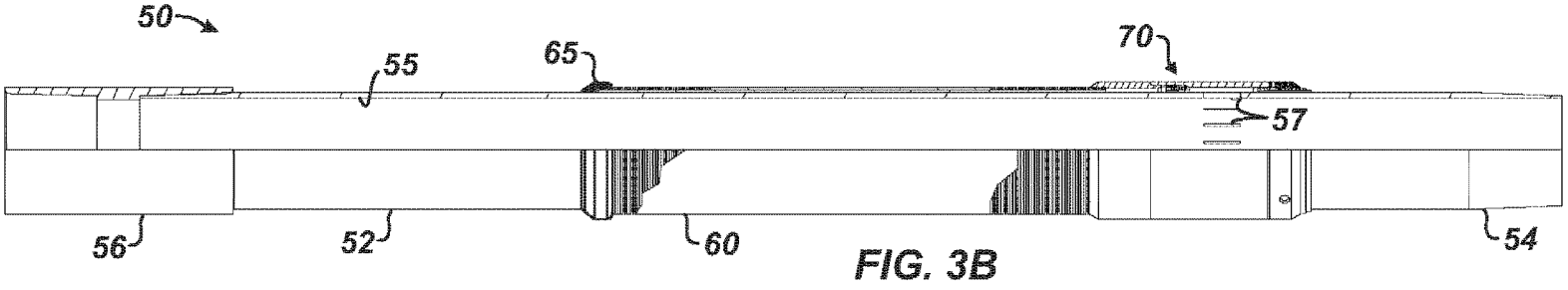
FIG. 3B illustrates the disclosed screen joint in partial cross-section.
Figure 3C:
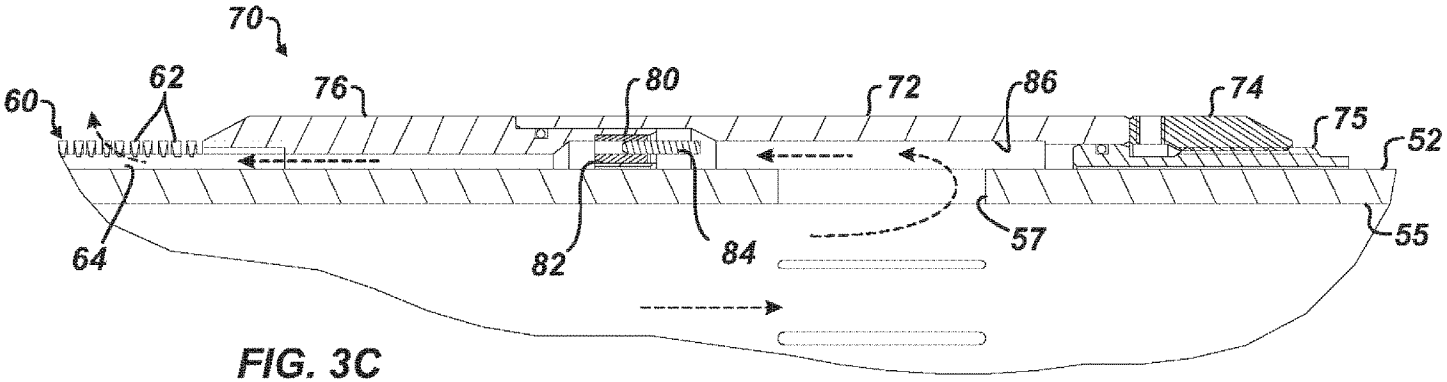
FIG. 3C illustrates a detail of the disclosed screen joint.

FIGS. 3A-3C illustrate a completion screen joint 50 in a side view, a partial side cross-sectional view, a detailed view, and a perspective view. The screen joint 50 has a basepipe 52 with a sand control jacket 60 and an inflow control device 70 disposed thereon. The basepipe 52 defines a through-bore 55 and has a coupling crossover 56 at one end for connecting to another joint or the like. The other end 54 can connect to a crossover (not shown) of another joint on the completion string. Inside the through-bore 55, the basepipe 52 defines perforations 57 where the inflow control device 70 is disposed.

The joint 50 is connected to a production string with the screen 60 typically mounted upstream of the inflow control device 70. As best shown in FIG. 3C, the device 70 has an outer sleeve 72 disposed about the basepipe 52 at the location of the perforations 57. A first end-ring 74 seals to the basepipe 52 with a seal element 75, and a second end-ring 76 attaches to the end of the screen 60. Overall, the sleeve 72 defines an annular space around the basepipe 52 that communicates the pipe ports 58 with the sand control jacket 60. The second end-ring 76 has flow ports 80, which separate the sleeve's inner space 86 from the screen 60.

For its part, the sand control jacket 60 is disposed around the outside of the basepipe 52. As shown, the sand control jacket 60 can be a wire wrapped screen having rods or ribs 64 arranged longitudinally along the basepipe 52 with windings of wire 62 wrapped thereabout to form various slots. Other types of filter media known in the art can be used so that reference to "screen" is meant to convey any suitable type of filter media. Fluid from the surrounding borehole annulus can pass through the annular gaps and travel between the sand control jacket 60 and the basepipe 52.

Internally, the inflow control device 70 has nozzles 82 disposed in flow ports 80. The nozzles 82 restrict the flow of screened fluid from the screen jacket 60 into the device's inner space 86 and produce a pressure drop in the fluid. For example, the inflow control device 70 can have ten nozzles 82. Operators set a number of these nozzles 82 open at the surface to configure the device 70 for use downhole in a given implementation. In this way, the device 70 can produce a configurable pressure drop along the screen jacket 60 depending on the number of open nozzles 82. To configure the device 70, pins 84 can be selectively placed in the passages of the nozzles 82 to close them off.

As noted in the background of the present disclosure, a sand screen joint incorporating an inflow control device installed across wellbore sections can make successfully killing a well difficult when flowing loss control fluid having a Loss Control Material (LCM). In general, the LCM may not have a clear path to the inside of the filter media in the sand screen joint 50 during the process of killing the well due to the inflow control device 70. Additionally, the restricted flow path through the inflow control device 70 can hinder the removal of the LCM from the inside of the filter media, which can be detrimental to later production or injection in the well after the event.

To improve the ability of the screen joint 50 with the inflow control device 70 to kill the well using LCM, the basepipe 52 of the disclosed screen joint 50 includes perforations 57 below the inflow control device's outer sleeve 72 having the form of accurately sized longitudinal slots, rather than the conventional perforations. The longitudinal slots 57 allow production/injection flow to enter/leave the basepipe 52 below the inflow control device 70 in the same manner as standardly available. However, in a well kill situation, solid particles of the LCM is expected to bridge off against the longitudinal slots 57 in the inside diameter of the basepipe 52 without needing to enter the sand screen 60 itself. To that end, the elongated slots 57 have a width significantly smaller than their length. The particle size of the LCM used during loss control operations is specifically selected to promote particle bridging across the sized slots 57.

Figure 4:
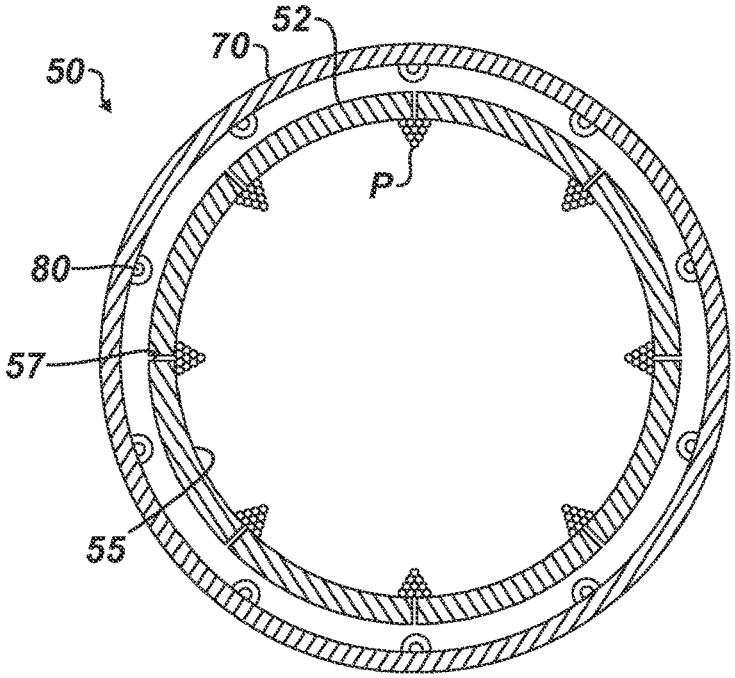
FIG. 4 schematically illustrates an end view of a basepipe having solid particles bridging off against longitudinal slots.

FIG. 4 schematically shows an end-section of the basepipe 52 with the longitudinal slots 57 defined around the circumference. Should the area of the formation (not shown) surrounding the basepipe 52, inflow control device 70, and screen (not visible) be an area where the fluid is leaking into the reservoir section, then the solid particles P of the LCM would tend to collect and bridge off against the narrow slots 57 to plug off the area temporarily.

Figure 5A:
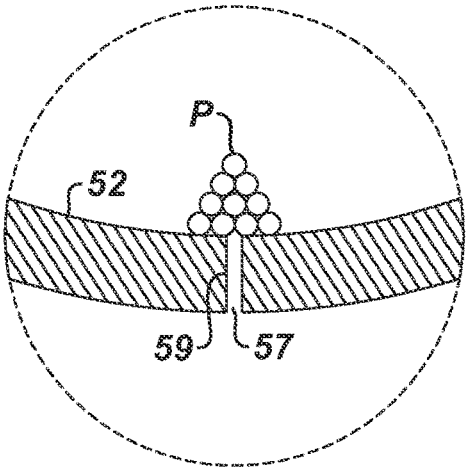
FIGS. 5A-5B illustrate end-sectional views of straight and keystone-shaped slots in a basepipe.

As shown in FIG. 5A, straight slots 57 formed in the basepipe 52 can be used. The straight slots 57 have parallel sidewalls 59 that are the same width all the way through the basepipe 52.

Figure 5B:
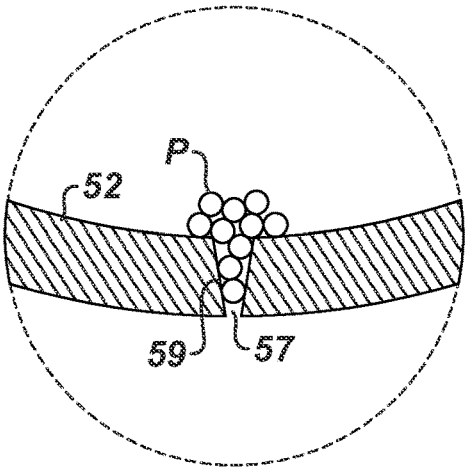

Different forms of slots 57 can also be used. For example, FIG. 5B shows slots 57 having the form of a keystone shape. The keystone slots 57 have sidewalls 59 that are wider at the inside diameter of the basepipe 52 than they are at the outside diameter. In other words, the slot 57 defines sides angling away from one another toward an interior of the basepipe 52. This may aid the solid particles P of the LCM in successfully bridging off when the well is killed and in clearing the slots 57 when the well is produced. A reverse angling could also be used.

The disclosed longitudinal slots 57 effectively create filter areas within the basepipe 52 for the LCM's particles P to bridge against. A separate section of filter media is not required inside the basepipe 52, making manufacture of the screen joint 50 less complicated and making its operation more reliable downhole.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A flow control apparatus for a borehole, comprising:

a basepipe having a bore for conveying fluid and defining at least one elongated slot permitting fluid communication between the bore and outside the basepipe; and at least one flow device disposed on the basepipe and having at least one flow restriction, the at least one flow restriction restricting fluid communication between outside the at least one flow device and the at least one elongated slot in the basepipe, the at least one flow device permitting both inflow and outflow between outside the at least one flow device and the at least one elongated slot in the basepipe without closing off the inflow and the outflow, the at least one elongated slot permitting both the inflow and the outflow between the at least one flow device and the bore of the basepipe, the at least one flow device and the at least one elongated slot communicating the inflow of the borehole fluid from outside the at least one flow device into the bore of the basepipe during a production operation without closing off the inflow of the borehole fluid, the at least one elongated slot and the at least one flow device initially communicating the outflow of basepipe fluid from the bore to outside the at least one flow device without closing off the outflow of the basepipe fluid during a loss control operation, the at least one elongated slot subsequently bridging off with particulate in the outflow of the basepipe fluid communicated in the bore of the basepipe to close off the outflow of the basepipe fluid beyond the at least one elongated slot during the loss control operation.

2. The apparatus of claim 1, further comprising filter media disposed on the basepipe, the filter media screening the inflow of the borehole fluid from outside the basepipe and communicating the inflow of the screened fluid with the at least one flow device.

3. The apparatus of claim 1, wherein the at least one flow restriction comprises at least one nozzle.

4. The apparatus of claim 1, wherein the at least one flow restriction comprises means for producing a pressure drop in the inflow of the borehole fluid.

5. The apparatus of claim 1, wherein the at least one flow device comprises:

a first end in fluid communication with the inflow of the borehole fluid from outside the basepipe; and a second end in fluid communication with the at least one flow restriction.

6. The apparatus of claim 1, wherein the at least one elongated slot defines parallel sides.

7. The apparatus of claim 1, wherein the at least one elongated slot defines sides angling away from one another toward an interior of the basepipe.

8. The apparatus of claim 1, wherein the at least one elongated slot defines a length greater than a width, the width being configured to engage a size of the particulate during the loss control operation.

9. The apparatus of claim 1, wherein the at least one elongated slot is defined along an axis of the basepipe.

10. The apparatus of claim 1, wherein the at least one elongated slot comprises a plurality of the elongated slot defined around an interior of the basepipe.

11. A sand screen joint for screening borehole fluid during a production operation and for bridging off with particulate in loss control fluid during a loss control operation, the joint comprising:

a basepipe having a bore and defining at least one elongated slot therein;

filter media disposed on the basepipe and screening the borehole fluid; and at least one flow device disposed on the basepipe and restricting communication of the borehole fluid from the filter media to the at least one elongated slot, the at least one flow device permitting both inflow and outflow between the filter media and the at least one elongated slot in the basepipe without closing off the inflow and outflow, the at least one elongated slot permitting both the inflow and the outflow between the at least one flow device and the bore of the basepipe, wherein during the production operation, the at least one flow device and the at least one elongated slot communicate the inflow of the borehole fluid without closing off the inflow from outside the at least one flow device into the bore, wherein during the loss control operation, the at least one elongated slot and the at least one flow device initially communicate the outflow of the loss control fluid without closing off the outflow from the bore to outside the at least one flow device, wherein during the loss control operation, the at least one elongated slot subsequently bridges off with the particulate in the outflow of the loss control fluid communicated in the bore of the basepipe to close off the outflow of the loss control fluid beyond the at least one elongated slot.

12. The apparatus of claim 11, wherein the at least one flow device comprises at least one nozzle.

13. The apparatus of claim 11, wherein the at least one flow device comprises means for producing a pressure drop in the inflow of the borehole fluid.

14. The apparatus of claim 11, wherein the at least one flow device comprises:

a first end in fluid communication with the borehole fluid from outside the basepipe; and a second end in fluid communication with the at least one elongated slot.

15. The apparatus of claim 11, wherein the at least one elongated slot defines parallel sides.

16. The apparatus of claim 11, wherein the at least one elongated slot defines sides angling away from one another toward an interior of the basepipe.

17. The apparatus of claim 11, wherein the at least one elongated slot defines a length greater than a width, the width being configured to engage a size of the particulate during the loss control operation.

18. The apparatus of claim 11, wherein the at least one elongated slot is defined along an axis of the basepipe.

19. The apparatus of claim 11, wherein the at least one elongated slot comprises a plurality of the elongated slot defined around an interior of the basepipe.

20. A flow control method for a borehole, comprising:

operating during a production operation permitting inflow of borehole fluid to communicate from outside at least one flow device to at least one elongated slot in a basepipe and to communicate from the at least one elongated slot to a bore of the basepipe without closing off the inflow of the borehole fluid by:

screening inflow of the borehole fluid from outside a screen and into at least one flow device on a basepipe;

restricting communication of the inflow of the screened fluid through at least one flow restriction of the at least one flow device; and communicating the inflow of the restricted fluid through at least one elongated slot in the basepipe and into the bore of the basepipe;

operating during a loss control operation permitting outflow of loss control fluid to communicate from the bore to at least one elongated slot and to communicate from the at least one elongated slot to outside the at least one flow device by:

initially communicating the loss control fluid in the outflow from the bore of the basepipe and through the at least one elongated slot without closing off the outflow; and subsequently closing off the outflow of the loss control fluid beyond the at least one elongated slot by bridging off the at least one elongated slot with particulate in the outflow of the loss control fluid communicated in the bore of the basepipe.

21. The method of claim 20, wherein restricting communication of the inflow of the screened fluid through the at least one flow restriction comprises producing a pressure drop in the inflow of the screened fluid.

* * * * *